US009982666B2

(12) United States Patent
Forni

(10) Patent No.: US 9,982,666 B2
(45) Date of Patent: May 29, 2018

(54) VACUUM PUMP SYSTEM INCLUDING SCROLL PUMP AND SECONDARY PUMPING MECHANISM

(71) Applicant: AGILENT TECHNOLOGIES, INC., Loveland, CO (US)

(72) Inventor: Ronald J. Forni, Lexington, MA (US)

(73) Assignee: Agilent Technologies, Inc., Santa Clara, CA (US)

( * ) Notice: Subject to any disclaimer, the term of this patent is extended or adjusted under 35 U.S.C. 154(b) by 374 days.

(21) Appl. No.: 14/726,404

(22) Filed: May 29, 2015

(65) Prior Publication Data

US 2016/0348679 A1 Dec. 1, 2016

(51) Int. Cl.

| | |
|---|---|
| ***F04B 41/06*** | (2006.01) |
| ***F04B 43/02*** | (2006.01) |
| ***F04C 29/12*** | (2006.01) |
| ***F04C 23/00*** | (2006.01) |
| ***F04B 23/12*** | (2006.01) |
| ***F04B 37/14*** | (2006.01) |

(Continued)

(52) U.S. Cl.

CPC ..... *F04B 41/06* (2013.01); *F04B 23/12* (2013.01); *F04B 37/14* (2013.01); *F04B 43/02* (2013.01); *F04C 18/0215* (2013.01); *F04C 23/005* (2013.01); *F04C 25/02* (2013.01); *F04C 29/126* (2013.01); *F04C 23/006* (2013.01)

(58) Field of Classification Search

CPC ..... F04B 23/12; F04B 37/14; F04B 41/06; F04B 43/02; F04C 18/0215; F04C 18/0261; F04C 23/005; F04C 23/006; F04C 23/008; F04C 25/02; F04C 29/12; F04C 29/126

USPC ..... 418/3, 5, 55.1, 55.5, 57, 270, DIG. 1

See application file for complete search history.

(56) References Cited

U.S. PATENT DOCUMENTS 3,464,227 A * 9/1969 Matthies ..... F25B 13/00 236/68 R
4,685,309 A * 8/1987 Behr ..... F25B 5/00 251/129.05

(Continued)

FOREIGN PATENT DOCUMENTS

EP 0730093 A1 9/1996
EP 1596066 A1 11/2005

(Continued)

OTHER PUBLICATIONS

UK Search Report dated Dec. 7, 2016 from related UK Application No. GB1609566.3.

*Primary Examiner* — Devon Kramer
*Assistant Examiner* — Joseph Herrmann

(57) ABSTRACT

A vacuum pump system includes a secondary pumping mechanism incorporated into a stationary portion of a scroll pump. The stationary portion includes the stationary plate scroll of the scroll pump and defines a gas passageway in which the secondary pumping mechanism is disposed. The gas passageway is connected to a gas flow path through the scroll pump at a location upstream of an exhaust check valve of the scroll pump. The secondary pumping mechanism is displaceable within the gas passageway to draw residual gas in the compression stage upstream of the check valve into the gas passageway, and may pump the residual gas back out through the exhaust check valve, to evacuate residual gas from the compression stage.

20 Claims, 5 Drawing Sheets

(51) Int. Cl.
*F04C 25/02* (2006.01)
*F04C 18/02* (2006.01)

(56) References Cited

U.S. PATENT DOCUMENTS 5,947,694 A * 9/1999 Hablanian ..... F04C 18/0215 417/201
5,961,297 A 10/1999 Haga et al.
6,213,731 B1 * 4/2001 Doepker ..... F01C 21/10 417/299
6,589,023 B2 * 7/2003 Royce ..... F04B 37/14 417/2
6,644,931 B2 * 11/2003 Puech ..... F04B 37/14 417/199.1
6,893,229 B2 5/2005 Choi et al.
7,189,066 B2 3/2007 Liepert
7,381,037 B2 * 6/2008 Kim ..... F04C 18/0215 417/310
7,654,098 B2 * 2/2010 Pham ..... A47F 3/04 62/217
7,837,452 B2 11/2010 Ignatiev et al.
2007/0160482 A1 * 7/2007 Inoue ..... F04B 41/06 417/206
2008/0145238 A1 6/2008 Shibiyama et al.
2012/0177522 A1 7/2012 Kim et al.
2012/0219443 A1 8/2012 Neel
2013/0089449 A1 4/2013 Seong et al.
2014/0010695 A1 1/2014 Ignatiev
2014/0147294 A1 5/2014 Fargo et al.
2014/0241909 A1 8/2014 Perevozchikov et al.

FOREIGN PATENT DOCUMENTS

WO WO2014012896 A2 1/2014
WO 2015197395 A1 12/2015

* cited by examiner

VACUUM PUMP SYSTEM INCLUDING SCROLL PUMP AND SECONDARY PUMPING MECHANISM

BACKGROUND

Representative embodiments are directed to vacuum pump systems for evacuating enclosed chambers such as processing chambers. In particular, representative embodiments are directed to vacuum pump systems that include a scroll pump.

A scroll pump is a type of pump that includes a stationary plate scroll having a spiral stationary scroll blade, an orbiting plate scroll having a spiral orbiting scroll blade, and an eccentric driving mechanism to which the orbiting plate scroll is coupled. The stationary and orbiting scroll blades are nested with a radial clearance and predetermined relative angular positioning such that a series of pockets are simultaneously defined by and between the blades. The orbiting plate scroll and hence, the orbiting scroll blade, is driven by the eccentric driving mechanism to orbit relative to the stationary plate scroll about a longitudinal axis of the pump passing through the axial center of the stationary scroll blade. As a result, the volumes of the pockets delimited by the scroll blades of the pump are varied as the orbiting scroll blade moves relative to the stationary scroll blade. The orbiting motion of the orbiting scroll blade also causes the pockets to move within the pump head assembly such that the pockets are selectively placed in open communication with an inlet and outlet of the scroll pump.

In a vacuum scroll pump, the motion of the orbiting scroll blade relative to the stationary scroll blade causes a pocket sealed off from the outlet of the pump and in open communication with the inlet of the pump to expand. Accordingly, fluid is drawn into the pocket through the inlet. The inlet of the pump is connected to a system that is to be evacuated, e.g., a system including a processing chamber in which a vacuum is to be created and/or from which gas is to be discharged. Then the pocket is moved to a position at which it is sealed off from the inlet of the pump and is in open communication with the outlet of the pump, and at the same time the pocket is contracted. Thus, the fluid in the pocket is compressed and thereby discharged through the outlet of the pump.

Moreover, vacuum scroll pumps are often used to remove air from chambers where the air may contain water vapor as a result of humidity. In this case, the water vapor in the air being exhausted may condense as the gas is compressed. If the amount of water vapor in the gas is relatively large, the saturation temperature of the gas being a function of both pressure and temperature, the saturation temperature will eventually exceed the actual gas temperature, at which point water will form as condensate of the gas between the blades of the scroll pump. This water can corrode components of the pump, and can absorb gases being pumped which can cause problems in the operation of the pump, etc.

To prevent condensation of gas inside a vacuum scroll pump, ballast gas (air or dry nitrogen, for example) is directed into the compression stage through a gas passageway at a location near but not at the downstream end of the compression stage. The ballast gas dilutes the gas being worked by the vacuum scroll pump in the compression stage. The added gas load also increases the temperature of the gas. The combination of these two factors reduces saturation pressure of the gas stream below the actual gas temperature and condensation of water vapor is prevented. In addition, the use of ballast gas applies to the vapors of other substances which will take liquid form at the combinations of pressure and temperature that can exist within a vacuum pump, e.g., various organic solvents.

SUMMARY

A representative embodiment of vacuum pump system includes the combination of a scroll pump, and a secondary pump having a secondary pumping mechanism incorporated into an outboard section of a scroll pump. In addition to the outboard section, the scroll pump has an inlet opening, an exhaust opening, an orbiting scroll blade, and an exhaust check valve. The outboard section includes a stationary scroll blade and defines a gas passageway therein. The orbiting scroll blade is nested with the stationary scroll blade so as to delimit therewith a series of pockets constituting a compression stage of the scroll pump. The pockets consist of an inlet pocket at which fluid is taken into the compression stage, an outlet pocket at which fluid is discharged from the compression stage, and at least one intermediate pocket between the inlet and outlet pockets with respect to said direction of flow of gas through the compression stage.

The inlet opening is connected to the compression stage at the inlet pocket of the compression stage, the exhaust opening is connected to the compression state at the outlet pocket of the compression stage, and the check valve is disposed in the exhaust opening. The gas passageway has a first end, and a second end at which the gas passageway is directly connected to a path of gas flow through the scroll pump that starts at the inlet opening, runs through the compression stage and ends at the check valve.

The secondary pump includes a secondary pumping mechanism operatively associated with said gas passageway of the scroll pump and is displaceable to draw gas into the second end of the gas passageway. Accordingly, residual gas in the compression stage upstream of the exhaust check valve can be evacuated from the compression stage.

Another representative embodiment of a vacuum pumping system includes an inlet at a vacuum side of the pump system where fluid is drawn into the pump system, an outlet constituting a compression side of the pump system where fluid is discharged under pressure from the pump system, a pump head assembly having a stationary portion and including a compression stage of a scroll pump, and a secondary pumping mechanism integrated with the stationary portion of the pump head assembly. The stationary portion defines an inlet opening to which the pump inlet extends, a gas passageway, and an exhaust opening leading to the pump outlet. The secondary pumping mechanism is disposed in the gas passageway. The stationary portion also includes a stationary scroll blade.

The pump head assembly also includes an orbiting plate scroll, an eccentric drive mechanism supported by the stationary portion, a pump motor connected to the eccentric drive mechanism, and a check valve supported by the stationary portion and having a valve head seated in the exhaust opening. The orbiting plate scroll comprises an orbiting scroll blade. The eccentric drive mechanism is supported by the stationary portion, and the orbiting plate scroll is coupled to the eccentric drive mechanism so as to be driven by the eccentric drive mechanism in an orbit relative to the stationary portion. The stationary and orbiting scroll blades are nested such that during the orbital motion of the orbiting plate scroll relative to the stationary plate scroll, a series of pockets are simultaneously defined between the nested stationary and orbiting scroll blades.

The series of pockets constitute a compression stage of the pump head assembly and consist of an inlet pocket at which fluid is taken into the compression stage, an outlet pocket at which fluid is discharged from the compression stage and at least one intermediate pocket between the inlet and outlet pockets with respect to a direction of flow of fluid through the compression stage.

The gas passageway defined by the stationary portion of the pump head assembly has a first end, and a second end at which the gas passageway is directly connected to a path of gas flow through the scroll pump that starts at the inlet opening, runs through the compression stage and ends at the check valve. The secondary pumping mechanism is displaceable within the gas passageway to draw gas into the second end of the gas passageway. Thus, residual gas in the compression stage upstream of the check valve can be evacuated from the compression stage.

Still another representative embodiment of a vacuum pumping system includes a stationary portion defining an inlet opening, a gas passageway, and an exhaust opening, and comprising a stationary scroll blade, an orbiting scroll blade nested with the stationary scroll blade so as to delimit therewith a series of pockets constituting a compression stage of the scroll pump, an exhaust check valve supported by the stationary portion and having a valve head seated in the exhaust opening, and a secondary pumping mechanism.

The gas passageway has an end at which the gas passageway opens directly into a path of gas flow through the scroll pump that starts at the inlet opening, runs through the compression stage and ends at the check valve. The secondary pumping mechanism is disposed in the gas passageway and is reciprocatable within the gas passageway so as to have an intake stroke by which the secondary pumping mechanism draws gas into the gas passageway, and a discharge stroke by which gas in the gas passageway forces the exhaust check valve open and is discharged from the pump system via the exhaust opening.

DETAILED DESCRIPTION OF THE PREFERRED EMBODIMENTS

Figure 1:
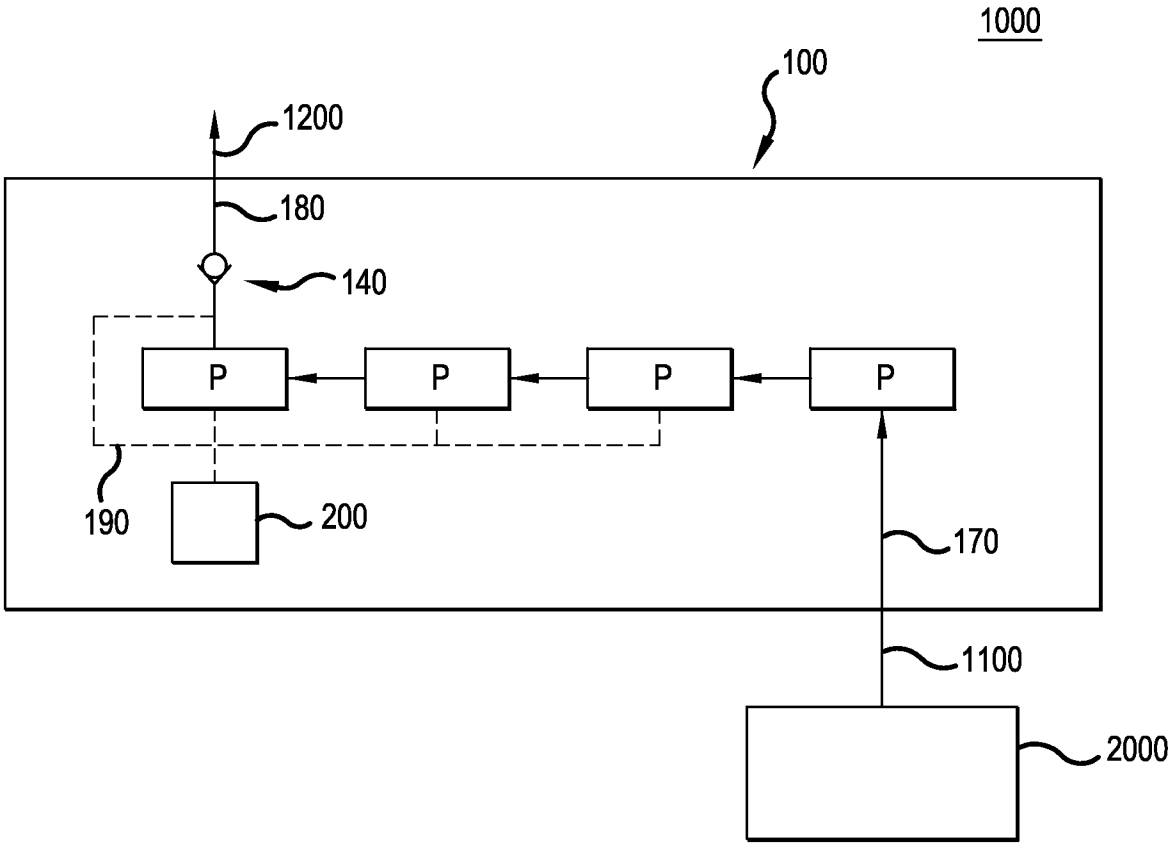
FIG. 1 is a block diagram of representative embodiments of a vacuum pump system.

Representative embodiments and examples of the embodiments will be described more fully hereinafter with reference to the accompanying drawings. In the drawings, the sizes and relative sizes of elements may be exaggerated for clarity. Likewise, the shapes of elements may be exaggerated and/or simplified for clarity and ease of understanding. Also, like numerals and reference characters are used to designate like elements throughout the drawings.

Furthermore, spatially relative terms are used to describe an element's relationship to another element(s) as illustrated in the figures. Thus, the spatially relative terms may apply to orientations in use which differ from the orientation depicted in the figures. Obviously, though, all such spatially relative terms refer to the orientation shown in the drawings for ease of description and are not necessarily limiting as apparatus according to the invention can assume orientations different than those illustrated in the drawings when in use.

Other terminology used herein for the purpose of describing particular examples or embodiments is to be taken in context. For example, the terms "comprises" or "comprising" when used in this specification indicates the presence of stated features but does not preclude the presence of additional features. The term "connected" may refer to a direct connection or a connection through the intermediary of one or more parts or component when not otherwise specified.

Referring first to FIG. 1, representative embodiments of a vacuum pump system 1000 generally includes a scroll pump 100 and a secondary pump 200. Furthermore, the vacuum pump system 1000 may have an inlet 1100 at a vacuum side of the pump system where fluid is drawn into the pump system, and an outlet 1200 constituting a compression side of the pump system where fluid is discharged under pressure from the pump system. The vacuum pump system 1000 can be connected, via its inlet 1100, to a chamber of a system or device 2000 in which a vacuum is to be created and/or from which gas is to be discharged. As will also be described in more detail later on, the scroll pump 100 has an inlet opening 170 and an outlet opening 180, and includes a compression stage defining a series of at least three pockets P which work to draw gas into the scroll pump 100 at the inlet opening 170 and force the gas out of the scroll pump through the outlet opening 180. The scroll pump 100 also has an exhaust check valve 140 that normally closes the compression stage to the outlet opening 180, i.e., is disposed downstream of the last of the pockets P with respect to the flow of gas through the scroll pump 100. Furthermore, in representative embodiments, the pump system 1000 has a gas passageway 190 that connects the secondary pump 200 directly to the primary path of gas flow of the scroll pump 100, namely a path running through the compression stage and ending at the exhaust check valve 140. Examples of the locations at which the gas passageway 190 is connected to this path are shown by dashed lines in FIG. 1 and will be described later.

Figure 2:
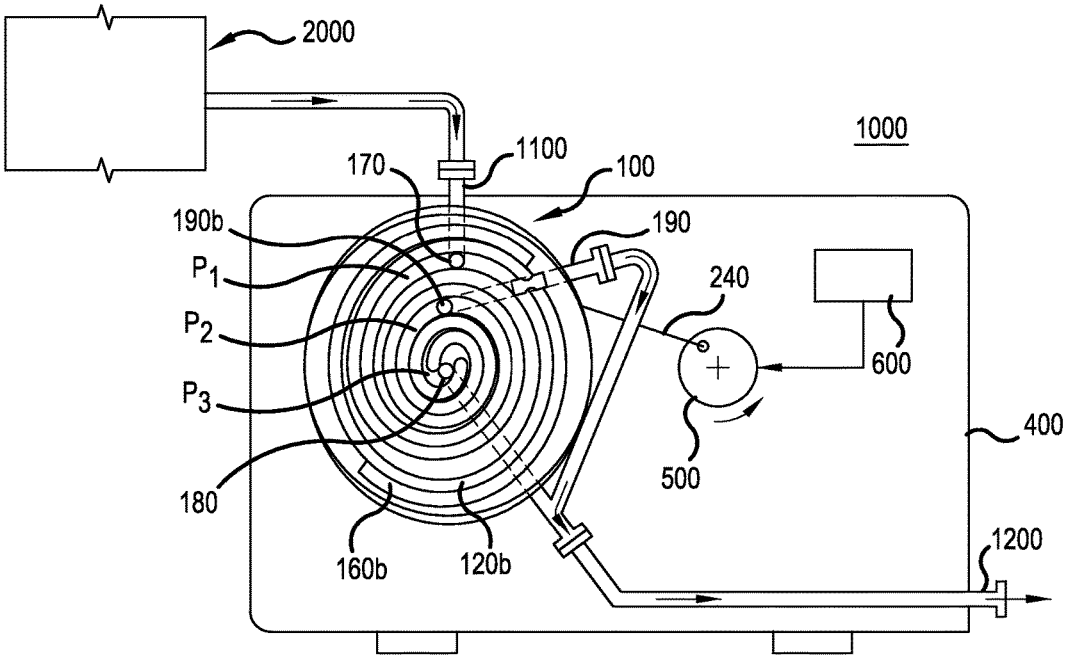
FIG. 2 is a schematic diagram of a first representative embodiment of a vacuum pump system.
Figure 3:
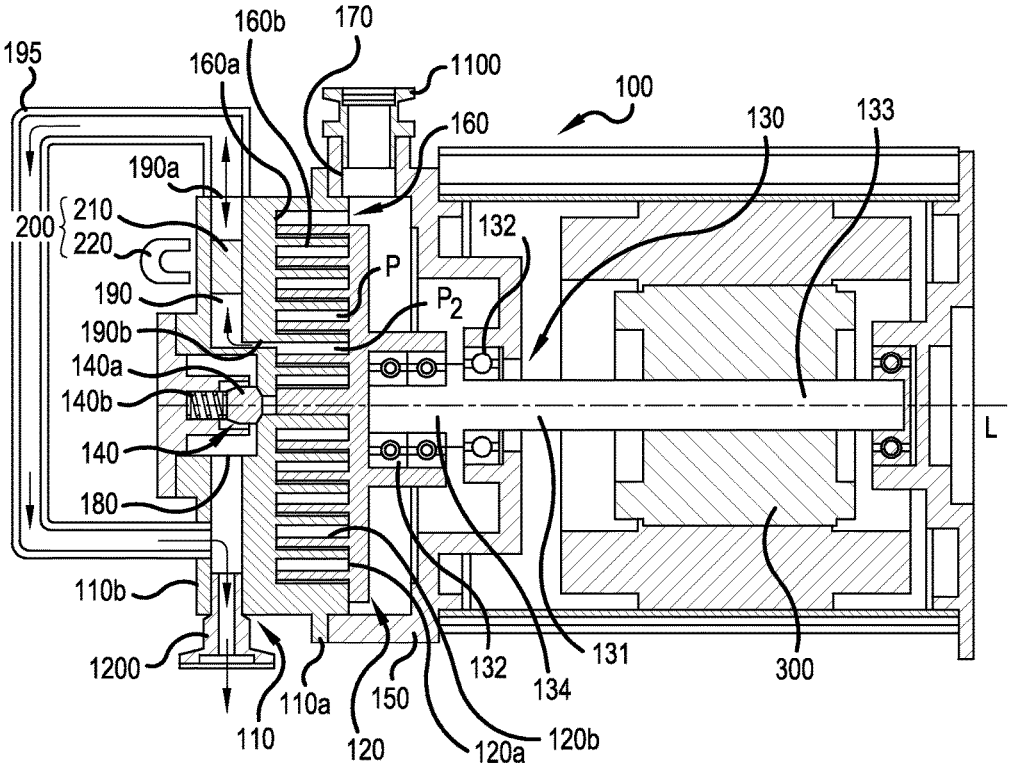
FIG. 3 is a longitudinal sectional view of a pump head assembly of the embodiment of FIG. 1.

Referring now to FIGS. 1-3, the scroll pump 100 and secondary pump 200 may be housed within a cowling 400. In a representative embodiment of vacuum pump system 1000, in addition to the features mentioned above, the scroll pump 100 includes an outboard section 110, an orbiting plate scroll 120, and an eccentric drive mechanism 130. The secondary pump 200 includes a secondary pumping mechanism 210 and an actuator 220. The scroll pump 100 also includes a motor 300 for driving the eccentric drive mechanism 130.

In one example of the representative embodiment, the outboard section 110, orbiting plate scroll 120, eccentric drive mechanism 130, and exhaust check valve 140 are integrated in a pump head assembly. The pump head assembly may further include a frame 150 to which the outboard section 110 is fixed. The frame 150 supports the eccentric drive mechanism 130. The frame 150 may be of one piece, i.e., may be unitary, or may comprise several integral parts that are fixed to one another. The outboard section 110 has an inner portion 110*a* and an outer portion 110*b*, and the inner portion 110*a* comprises a stationary plate scroll 160. The inner and outer portions 110*a* and 110*b* of the outboard section 110 of the pump head assembly may be separate but integral parts or may be unitary. That is, the stationary plate scroll 160 may be fixed to or unitary with an outboard portion of the pump head assembly. In any case, the frame 150 and outboard section 110 constitute a stationary portion of the pump head assembly in this example. Thus, the stationary plate scroll 160 is fixed to the frame 150.

The stationary portion, e.g., the frame 150, of the pump head assembly defines the inlet opening 170 to which the pump inlet 1100 extends. Also, the stationary portion, e.g., the outboard section 110, of the pump head assembly defines the exhaust opening 180 leading to the pump outlet 1200, and gas passageway 190. The gas passageway 190 has a first end 190*a* (port) leading to the outside of the pump system, e.g., to the pump outlet 1200, and a second end (port) 190*b* at which the gas passageway 190 is directly connected to the gas flow path. The secondary pumping mechanism 210 is disposed in the gas passageway 190. The exhaust check valve 140 may comprise a valve head 140*a*, and spring 140*b* biasing the valve head 140*a* to a normally closed position.

The stationary plate scroll 160 comprises a floor (or stationary plate) 160*a* and a stationary scroll blade 160*b* projecting axially from the floor 160*a*. The orbiting plate scroll 120 comprises a floor (orbiting plate) 120*a* and an orbiting scroll blade 120*b* projecting axially from the floor 120*a*. The orbiting scroll blade 120*b* and the stationary scroll blade 160*b* are nested with a clearance and predetermined relative angular positioning such that the series of pockets P, constituting the aforementioned compression stage, are simultaneously formed by and between the orbiting and stationary scroll blades 120*b*, 160*b*.

In this respect, and as is known per se, portions of the scroll blades 120*b*, 160*b* need not contact each other to seal the pockets P and delineate the pockets P from one another. Rather, minute radial clearances between portions of the scroll blades 120*b*, 160*b* create seals sufficient for forming satisfactory pockets P delineated from one another. In addition, the scroll pump 100 may have a tip seal (not shown) to create an axial seal between the scroll blade of one of the orbiting and stationary plate scrolls and the floor or plate of the other of the orbiting and stationary plate scrolls. The tip seal may be a plastic member seated in a groove in and running the length of the tip of the scroll blade of one of the stationary and orbiting plate scrolls so as to be interposed between the tip of the scroll blade and the floor or plate of the other of the stationary and orbiting plate scrolls. Such tip seals are known per se and accordingly, will not be described here in further detail.

As best shown in FIG. 3, the eccentric drive mechanism 130 may take any form of those employed by scroll pumps and thus, may include a crank shaft 131 and bearings 132. In this example, the crank shaft 131 has a main portion 133 coupled to the motor 300 so as to be rotated by the motor about the longitudinal axis L of the scroll pump 100, and a crank 134 whose central longitudinal axis is offset in a radial direction from the longitudinal axis L. Also, in this example, the main portion 133 of the crank shaft is supported by the frame 150 via one or more sets of the bearings 132 so as to be rotatable relative to the frame 150. The orbiting plate scroll 120 is mounted to the crank 134 via another set or sets of the bearings 132. Thus, the orbiting plate scroll 120 is carried by crank 134 so as to orbit about the longitudinal axis of the scroll pump when the main portion 133 of the crankshaft is rotated by the motor 300, and the orbiting plate scroll 120 is supported by the crank 134.

During a normal operation of the pump, loads on the orbiting scroll blade 120*b* tend to cause the orbiting plate scroll 120 to rotate about the central longitudinal axis of the crank 134. Therefore, a mechanism (not shown) such as an Oldham coupling or metallic bellows may be provided for restraining the orbiting plate scroll 120 in such a way as to allow it to orbit about the longitudinal axis L of the scroll pump while inhibiting its rotation about the central longitudinal axis of the crank 134.

The orbiting motion of the orbiting scroll blade 120*b* relative to the stationary scroll blade 160*b* causes a pocket P open to the inlet opening 170 to expand. Accordingly, gas is drawn into the pocket inlet P through the inlet opening 170. Then the pocket P is moved to a position at which it is sealed off from the inlet opening 170 and the exhaust opening 180 by the small radial clearances between the nested scroll blades 120*b*, 160*b*. Finally, the pocket P is moved to a position at which it is in open communication with the outlet opening 180, and at the same time the pocket P is contracted. Thus, the gas in the pocket P is compressed and once the gas reaches a certain discharge pressure, the gas opens the exhaust check valve 140 and is discharged from the scroll pump 100 and pumping system through the exhaust opening 180 and pump outlet 1200.

Referring back to FIGS. 1 and 2, at any point in time, therefore, the series of pockets P constituting the compression stage of the scroll pump 100 include an inlet pocket $P_1$ at which fluid is being taken into the compression stage, an outlet pocket $P_3$ from which fluid is being discharged from the compression stage, and at least one intermediate pocket $P_2$ between the inlet and outlet pockets $P_1$, $P_3$ with respect to the direction of flow of gas from inlet opening 170 to exhaust opening 180 through the compression stage. That is, the inlet pocket $P_1$ is the pocket that opens directly to the inlet opening 170, the outlet pocket $P_3$ is the pocket that directly opens to the exhaust opening 180 and the intermediate pocket(s) P2 is/are sealed from the inlet opening 170 and exhaust opening 180.

In one example of the representative embodiment, the compression stage is constituted by the inlet pocket $P_1$, the outlet pocket $P_3$ and a plurality of intermediate pockets $P_2$ in series between the inlet and outlet pockets $P_1$ and $P_3$ pockets. As shown by the dashed lines in FIG. 1: (1) the gas passageway 190 may be directly connected to the gas flow path at a location between the exhaust check valve 140 and the outlet pocket $P_3$, and (2) the gas passageway 190 may be alternatively or additionally directly connected to one or more of the pockets P. In examples of the representative embodiment in which the gas passageway 190 is directly connected to one or more of the pockets P, the gas passageway 190 is preferably directly connected to only one or more of the pockets P that is/are located closer to the outlet opening 180 than the inlet opening 170 with respect to the direction of flow of gas through the compression stage.

As concerns these examples, vacuum scroll pumps rely on the aforementioned small internal clearances and numbers of turns (also referred to as "wraps") of the spiral scroll blades to generate the compression required to meet the ultimate pressure requirements of the pump.

Especially in the case in which the scroll pump is operating while meeting its ultimate pressure requirements, the inlet side of the scroll pump is at a low pressure, and the exhaust side of the pump is at a relatively high pressure. The pressure differential from exhaust side to the inlet side creates a potential for leakage of the gas in the pump in a direction from the exhaust side to the inlet side through the internal clearances between the plate scrolls. Furthermore, this potential for leakage is increased as the tip seal(s) between the plate scrolls begin to wear. In any case, such a backflow of the gas may not only affect the performance of the pump but may, in turn, upset the operation of the device or system connected to the scroll pump.

The secondary pump 200 can mitigate this potential problem by evacuating residual gas from the gas flow path at a location(s) immediately upstream of the exhaust check valve 140. This will be explained in more detail below.

In the illustrated examples of the representative embodiment, the gas passageway 190 communicates with the compression stage upstream of the exhaust check valve 140. Furthermore, the secondary pumping mechanism 210 of the secondary pump 200 is disposed in the gas passageway 190. The secondary pumping mechanism 210 may be a piston, and the actuator 220 is operative to reciprocate the piston 210 in the gas passageway 190 as shown by the double-headed arrow in FIG. 3.

During the intake stroke of the secondary pump 200, the piston 210 is moved in a direction toward the first end 190*a* of the gas passageway 190, i.e., away from the compression stage, thereby drawing gas into the gas passageway 190 from a space between the exhaust check valve 140 and/or from the outlet pocket P3, and may at the same time draw gas into the gas passageway 190 from at least one of the intermediate pockets $P_2$. In practice, the intake stroke may be sufficient to draw in gas from more than one or all of the intermediate pockets $P_2$ as well as the inlet pocket $P_1$ through the small radial clearances between the scroll blades 120*b*, 160*b*. In any case, the check valve 140 prevents the gas drawn into the gas passageway 190 during the intake stroke of the secondary pump 200 from flowing back into the compression stage. In examples of the representative embodiment, the intake stroke of the secondary pump 200 evacuates residual gas immediately upstream of check valve 140 such that the pressure in the space just upstream of the check valve 140 is approximately 10-200 Torr.

During the discharge stroke of the secondary pump 200, the piston 210 is moved in a direction toward the second end 190*b* of the gas passageway 190, i.e., toward the compression stage, and thereby increases the pressure of the gas between the piston 210 and (the valve head 140*a* of) the check valve 140 to a pressure greater than the discharge pressure of the check valve 140 (force of the spring 140*b*). As a result, the check valve 140 is opened and gas is forced to the outlet opening 180, i.e., out to the scroll pump 100, thereby reducing the mass of residual gas in the compression stage. During the exhaust stroke some of this gas may leak back to the inlet opening 170 but by appropriately setting the speed of the discharge stroke, the majority of the gas can be discharged past the exhaust check valve 140.

In some applications, the secondary pump 200 would need to be hermetic to prevent the working gas from leaking to the atmosphere and vice versa.

FIGS. 2 and 3 show an example of the representative embodiment that meets this requirement. In this example, the pumping mechanism 210 of the secondary pump 200 comprises magnetic material and is fitted to the outboard section 110 so as to provide an airtight seal in the gas passageway 190. A gas line 195 connects the first end 190*a* of the gas passageway 190 to the outlet opening 180 as extending around (bypassing) the exhaust check valve 140, the gas line 195 to allow the seal created by the pumping mechanism 210 to reciprocate in the gas passageway 190. The actuator 220 of the secondary pump 200 is a linearly driven magnetic material disposed outside a relatively thin wall of the outboard section 110 that defines the gas passageway.

Figure 4:
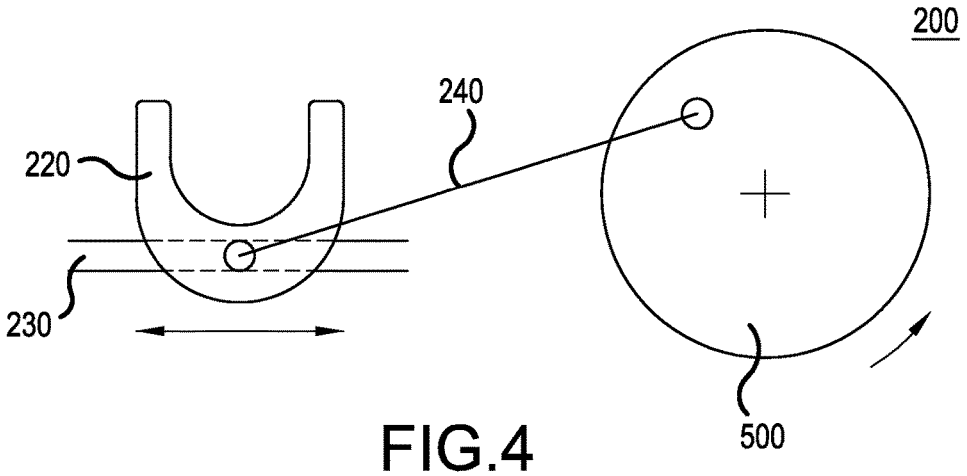
FIG. 4 is a schematic diagram of the secondary pump of the vacuum pump system shown in FIG. 3 and illustrating one way in which the secondary pump mechanism of the system can be driven.

FIGS. 2 and 4 show an example in which the secondary pump 200 also comprises a motor 500 such as a gear motor, a connecting rod 240 connecting the motor 500 to the magnet actuator 220, and a linear guide 230 for guiding the magnet 220. A controller 600 of the vacuum pump system (FIG. 2) may be operatively connected to the motor 500 and configured to operate the secondary pump 200 intermittently. Thus, the motor 500 may serve as an intermittent driver of the actuator 220. The controller 600 may also be operatively connected to the motor 300 of the scroll pump 100 to operate the secondary pump 200 synchronously with the scroll pump 100.

Figure 5:
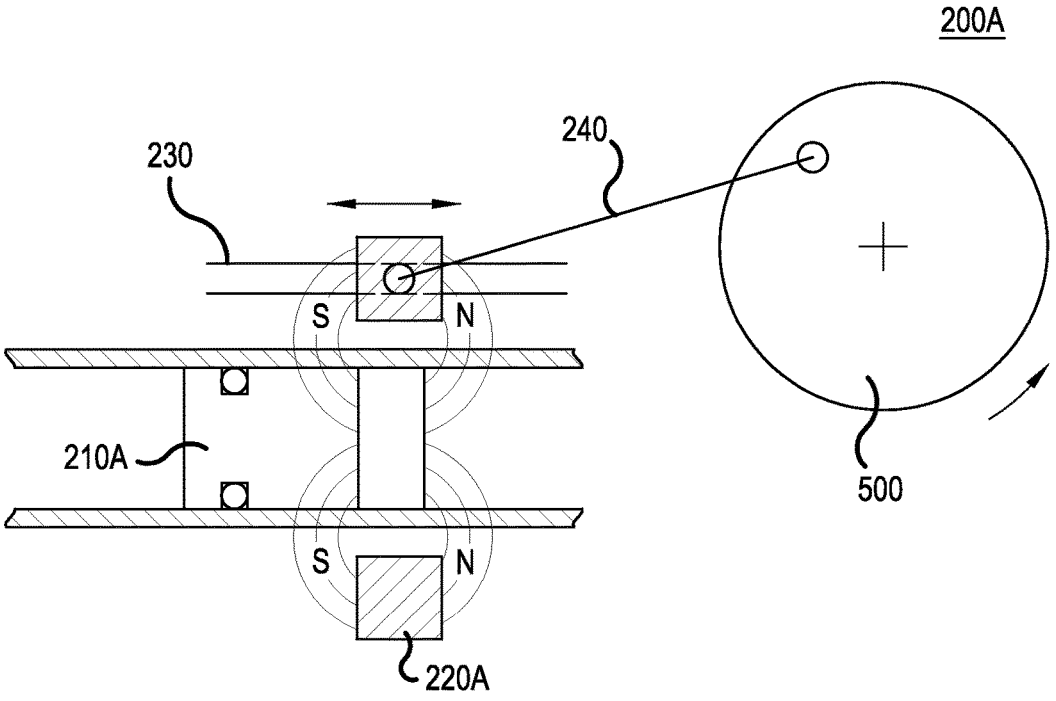
FIG. 5 is a schematic diagram of another version of the secondary pump of the vacuum pump system shown in FIG. 3.

FIG. 5 shows another version of the secondary pump 200A having a piston 210A comprising magnetic material, and magnet 220A as the actuator for the piston 210A. With reference to FIG. 3, the magnet 220A is disposed on opposite sides of a thin-walled portion of the outboard section 110 (FIG. 3) defining the gas passageway 190 of the scroll pump 100.

Figure 6:
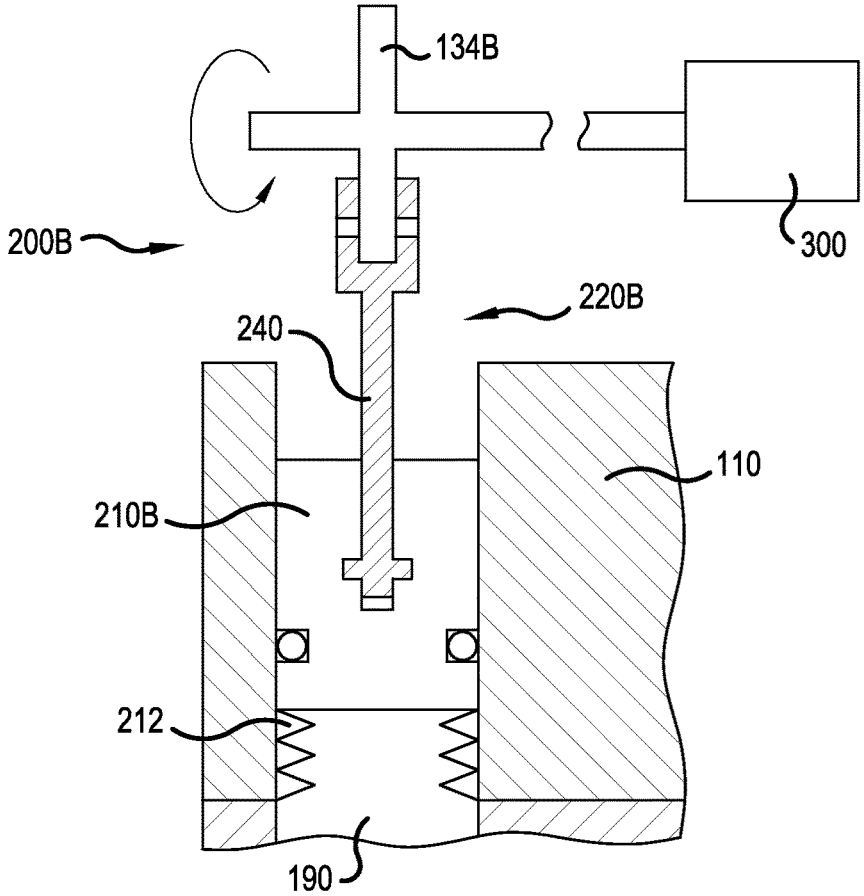
FIG. 6 is an enlarged schematic diagram of another example of a secondary pump of a representative embodiment of a vacuum pump system.

FIG. 6 shows a secondary pump 200B of another representative embodiment of a vacuum pump system. In this embodiment, the motor 300 of the scroll pump 100 is used to drive the actuator 220B of the secondary pump 200B. For example, connecting rod 240 is mounted to a second crank or eccentric 134B connected in common to the motor 300 that drives the eccentric drive mechanism of the vacuum scroll pump. An appropriate seal such as a bellows 212 may be provided in lieu of or along with a piston seal to create a seal between the location at which the connecting rod 240 is connected to the secondary pumping mechanism 210B and the gas passageway 190.

Figure 9:
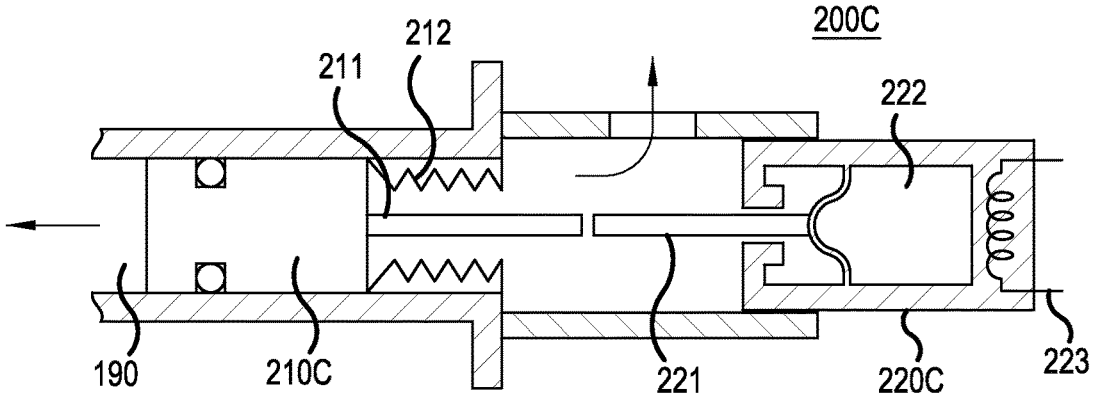
FIG. 9 is an enlarged schematic diagram of the secondary pump of the embodiment of FIG. 7.
Figure 7:
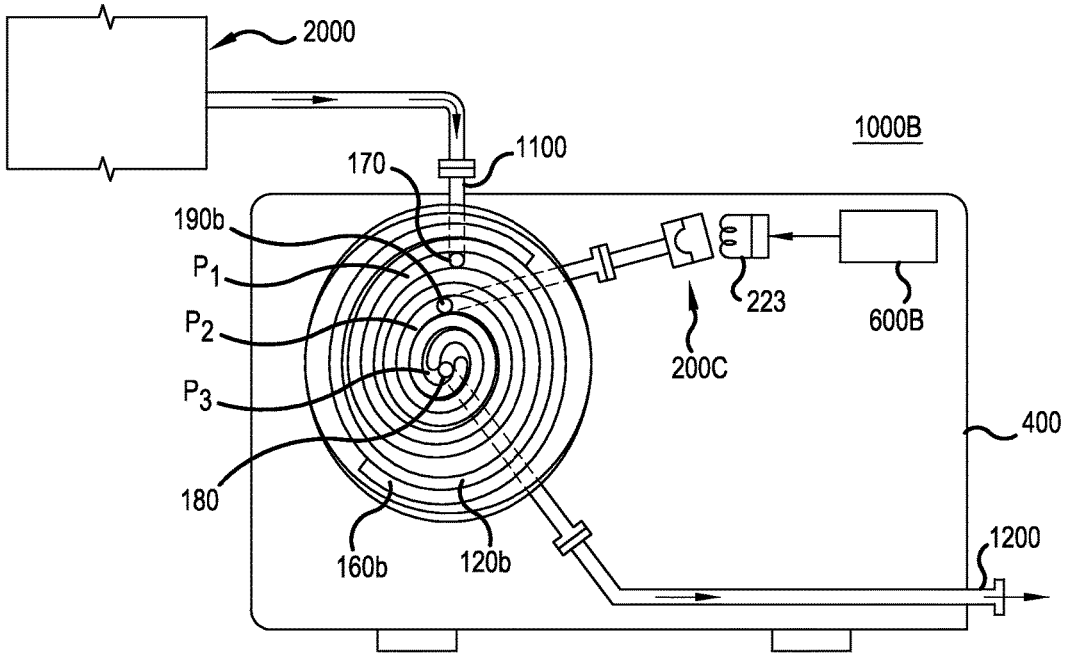
FIG. 7 is a schematic diagram of a third representative embodiment of a vacuum pump system.
Figure 8:
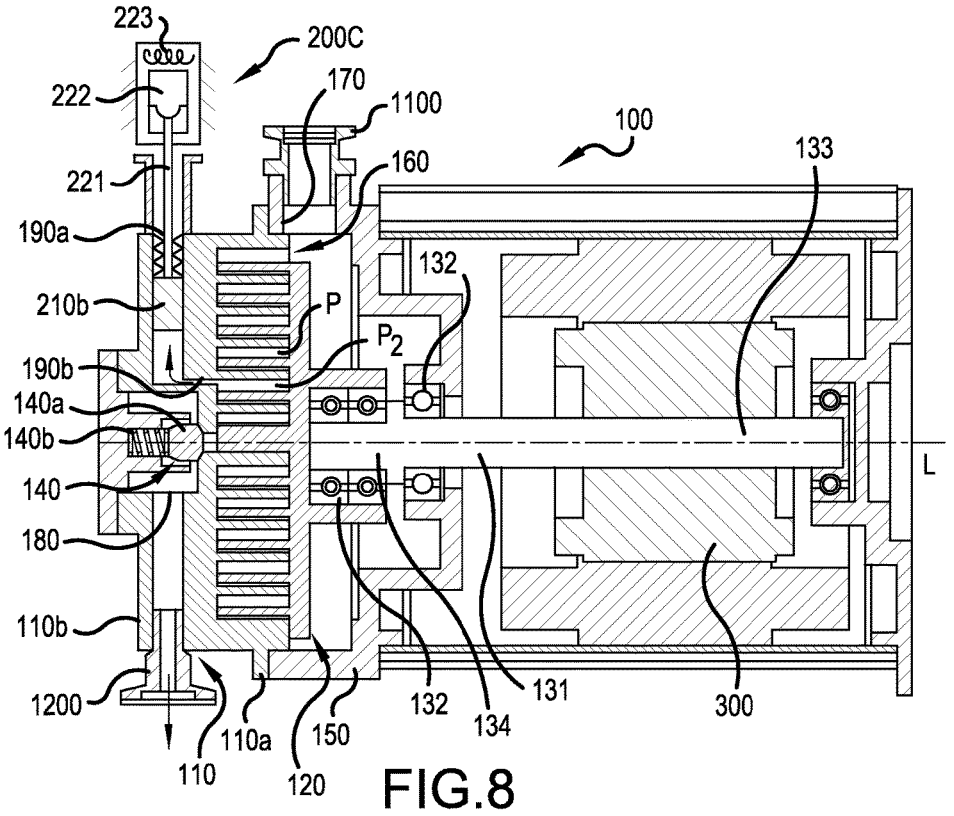
FIG. 8 is a longitudinal sectional view of a pump head assembly of the embodiment of FIG. 7.

FIGS. 7-9 illustrate another representative embodiment of the vacuum pumping system 1000B. In this embodiment the secondary pump 200C comprises a secondary pumping mechanism 210C and a thermal actuator 220C.

In the illustrated example of this embodiment, the secondary pumping mechanism 210C, like that of the embodiments of FIGS. 2 and 6, comprises a piston fitted within the gas passageway 190 so as to be reciprocatable within the passageway 190. The secondary pump 200C also includes a rod 211 extending from the piston 210C, and a metallic bellows 212 disposed within the gas passageway 190. The bellows 212 is fixed to and extends between the piston 210C and the stationary part, e.g., the outboard section 110, of the scroll pump 100 so as to provide a hermetic seal in the gas passageway 190 between the compression stage of the scroll pump 100 and the atmosphere outside the pump system 1000B. The thermal actuator 220C may include a housing containing a thermally sensitive substance 222 (e.g., a wax) that expands when heated, a heater 223 for heating the substance 222, and a rod 221 engaged with a flexible part of the housing containing the substance 222 and guided by the housing so as to extend and retract when the substance 222 is heated and cooled, respectively. A controller 600B of the vacuum pump system 1000B may be operatively connected to the heater 223 for turning the heater 223 off and on, e.g., may be operatively connected to a power source of the heater 223 for supplying current through a heating element of the heater 223. Accordingly, the thermal actuator 220C, as the description below makes clear, may be operated intermittently under the control of the controller 600B.

The rod 221 of the thermal actuator 220C is axially aligned with the rod 211 fixed to and projecting from the piston 210C. Although the rods 211 and 221 in this example are separate and abut end-to-end, alternatively, the rods 211 and 221 may be joined together. In any case, when the heater 223 is turned on, the substance 222 expands, and the rod 221 is extended. As a result, the piston 210C is slid towards the second end 190*b* of the gas passageway 190 through the intermediary of the rod 221 and the rod 211 fixed to the piston 210C. At the same time the bellows 212 is stretched. Thus, the discharge stroke of the secondary pump 200C is produced in which residual gas in the compression stage is forced through the exhaust check valve 140 of the scroll pump. On the other hand, when the heater 223 is turned off, the substance 222 cools and contracts, thereby pulling the piston 211 toward the first end of the gas passageway 190 and producing the intake stroke of the secondary pump 200C in which residual gas in the compression stage is drawn into the gas passageway 190 from a location immediately upstream of the exhaust check valve 140 of the scroll pump. In the case in which the rods 211 and 221 are joined, the contraction of the thermally sensitive substance 222 of the thermal actuator 220C may also produce the intake stroke.

A representative embodiment as described above may provide one or more of the following benefits:

(1) a dramatic reduction in the base pressure of the scroll pump of a vacuum pumping system as a result of the reduced pressure upstream of the exhaust check valve which, in turn, results in a corresponding reduction in the leakage of the gas back to the pump inlet;

(2) a reduction in the amount of work needed to compress the gas in the compression stage resulting in a substantial reduction in power draw of the scroll pump 100 at base pressure conditions;

(3) lower temperature of the pump head and increased life of the bearings/grease of the scroll pump at base pressure conditions as a result of the reduced power draw of the scroll pump;

(4) increase in the life of the tip seal(s) as a result of eliminating the gas actuating pressure which acts to wear away the tip seal near the axial center of the scroll pump;

(5) reducing the amount of condensation of the gas in the compression stage; and (6) the secondary pump is relatively simple.

With respect to (5), the condensation can be eliminated by designing the secondary pump to reduce the pressure of the gas immediately upstream of the exhaust check valve below the boiling point of water. With respect to (6), the secondary pump does not require a dedicated valve(s), i.e., makes use of the exhaust check valve of the scroll pump to pump residual gas from the compression stage. Furthermore, the gas passageway in which the pumping mechanism of the secondary pump is disposed may be substantially the same as a gas ballast passageway conventionally provided in some scroll pumps for introducing ballast gas into the compression stage. Moreover, it is readily apparent that the displacement and operating speed of the secondary pump are each orders of magnitude less than those of the scroll pump. Thus, the secondary pump may be realized at a low cost and even allows for intermittent operation so that is may possess a relatively long useful life.

Finally, embodiments of the inventive concept and examples thereof have been described above in detail. The inventive concept may, however, be embodied in many different forms and should not be construed as being limited to the embodiments described above. For example, although the present invention has been described in detail with respect to vacuum scroll pumps, the present invention may be applied to other types of vacuum pumps that include a compression mechanism constituted by at least one pocket whose volume is varied to draw fluid into the pump and expel the fluid from the pump. Accordingly, the embodiments and examples of the invention were described so that this disclosure is thorough and complete, and fully conveys the inventive concept to those skilled in the art. Thus, the true spirit and scope of the inventive concept is not limited by the embodiment and examples described above but by the following claims.

What is claimed is:

1. A vacuum pump system comprising the combination of a scroll pump, and a secondary pump, wherein the scroll pump has an inlet opening, an exhaust opening, an outboard section, an orbiting scroll blade, and an exhaust check valve, the outboard section includes a stationary scroll blade and defines a gas passageway therein, the orbiting scroll blade is nested with the stationary scroll blade so as to delimit therewith a series of pockets constituting a compression stage of the scroll pump, the pockets consist of an inlet pocket at which fluid is taken into the compression stage, an outlet pocket at which fluid is discharged from the compression stage, and at least one intermediate pocket between the inlet and outlet pockets with respect to said direction of flow of gas through the compression stage, the exhaust opening is connected to the compression stage at the outlet pocket of the compression stage, and the check valve is disposed in the exhaust opening, and the gas passageway has a first end, and a second end at which the gas passageway is directly connected to a path of gas flow through the scroll pump that starts at the inlet opening, runs through the compression stage and ends at the check valve, and wherein the secondary pump comprises a secondary pumping mechanism operatively associated with said gas passageway of the scroll pump and displaceable to draw gas into the second end of the gas passageway from the gas flow path such that residual gas in the compression stage upstream of the exhaust check valve can be evacuated from the compression stage.

2. The vacuum pump system of claim 1, wherein the at least one intermediate pocket comprises a plurality of intermediate pockets in series between the inlet and outlet pockets with respect to said direction of flow of gas through the compression stage, and the second end of the gas passageway is directly connected to one of the intermediate pockets.

3. The vacuum pump system of claim 1, wherein the secondary pumping mechanism provides a hermetic seal in said gas passageway between the compression stage and the atmosphere outside the pump system.

4. The vacuum pump system of claim 1, wherein the secondary pumping mechanism comprises a piston disposed within said gas passageway.

5. The vacuum pump system of claim 4, wherein the piston is magnetic, and wherein the secondary pump comprises a magnetic actuator disposed outside of the gas passageway and operable to reciprocate the piston within the gas passageway.

6. The vacuum pump system of claim 4, wherein the secondary pump comprises a thermal actuator that reciprocates the piston within the gas passageway.

7. The vacuum pump system of claim 4, wherein the secondary pump further comprises a bellows disposed within the gas passageway, the bellows being fixed to and extending between the piston and to the outboard section of the scroll pump so as to provide a hermetic seal in the gas passageway between the compression stage of the scroll pump and the atmosphere outside the pump system.

8. The vacuum pump system of claim 1, wherein the secondary pump comprises an intermittent driver operatively connected to the secondary pumping mechanism so as to drive secondary pumping mechanism intermittently.

9. The vacuum pump system of claim 8, wherein the intermittent driver comprises a motor, and a controller operatively connected to the motor and configured to operate in a mode in which the motor is run intermittently.

10. A vacuum pump system comprising:

an inlet at a vacuum side of the pump system where fluid is drawn into the pump system;

an outlet constituting a compression side of the pump system where fluid is discharged under pressure from the pump system; and a pump head assembly including:

a stationary portion defining an inlet opening to which the pump inlet extends, an exhaust opening leading to the pump outlet, and a gas passageway, and the stationary portion comprising a stationary scroll blade, an orbiting plate scroll comprising an orbiting scroll blade, an eccentric drive mechanism supported by the stationary portion, the orbiting plate scroll being coupled to the eccentric drive mechanism so as to be driven by the eccentric drive mechanism in an orbit relative to the stationary portion, an exhaust check valve supported by the stationary portion and having a valve head seated in the exhaust opening, and a secondary pumping mechanism disposed in the gas passageway, and wherein the stationary and orbiting scroll blades are nested such that a series of pockets are delimited by the nested stationary and orbiting scroll blades, the series of pockets constitute a compression stage of the pump head assembly and consist of an inlet pocket at which fluid is taken into the compression stage, an outlet pocket at which fluid is discharged from the compression stage and at least one intermediate pocket between the inlet and outlet pockets with respect to a direction of flow of fluid through the compression stage, the gas passageway has a first end, and a second end at which the gas passageway is directly connected to a path of gas flow that starts at the inlet opening, runs through the compression stage and ends at the check valve, and the secondary pumping mechanism is displaceable within the gas passageway to draw gas into the second end of the gas passageway such that residual gas in the compression stage upstream of the check valve can be evacuated from the compression stage.

11. The vacuum pump system of claim 10, wherein the at least one intermediate pocket comprises a plurality of intermediate pockets defined by and between the nested stationary and orbital scroll blades in series with respect to said direction of flow of gas through the compression stage, and the second end of the gas passageway is directly connected.

12. The vacuum pump system of claim 10, wherein the secondary pumping mechanism provides a hermetic seal in said gas passageway between the compression stage and the atmosphere outside the pump system.

13. The vacuum pump system of claim 10, wherein the secondary pumping mechanism comprises a piston disposed within said gas passageway.

14. The vacuum pump system of claim 13, wherein the piston is magnetic, and further comprising a magnetic actuator disposed outside of the gas passageway and operable to reciprocate the piston within the gas passageway.

15. The vacuum pump system of claim 13, further comprising a thermal actuator operable to reciprocate the piston within the gas passageway.

16. The vacuum pump system of claim 13, further comprising a bellows disposed within the gas passageway, the bellows being fixed to and extending between the piston and the stationary portion so as to provide a hermetic seal in the gas passageway between the compression stage and the atmosphere outside the pump system.

17. The vacuum pump system of claim 10, further comprising an intermittent driver operatively connected to the secondary pumping mechanism so as to drive secondary pumping mechanism intermittently.

18. The vacuum pump system of claim 17, wherein the intermittent driver comprises a motor, and a controller operatively connected to the motor and configured to operate in a mode in which the motor is run intermittently.

19. A vacuum pump system comprising:

a stationary portion defining an inlet opening, a gas passageway, and an exhaust opening, and the stationary portion comprising a stationary scroll blade;

an orbiting scroll blade nested with the stationary scroll blade so as to delimit therewith a series of pockets constituting a compression stage of the scroll pump;

an exhaust check valve supported by the stationary portion in the exhaust opening; and a secondary pumping mechanism, and wherein the gas passageway has an end at which the gas passageway opens directly to a path of gas flow that starts at the inlet opening, runs through the compression stage and ends at the check valve, and the secondary pumping mechanism is disposed in the gas passageway and is reciprocatable within the gas passageway so as to have an intake stroke by which the secondary pumping mechanism draws gas into the gas passageway from the path of gas flow such that residual gas in the compression stage upstream of the check valve can be evacuated from the compression stage, and a discharge stroke by which gas in the gas passageway forces the exhaust check valve open and is discharged from the pump system via the exhaust opening.

20. The vacuum pumping system of claim 19, wherein the secondary pumping mechanism provides a hermetic seal in the gas passageway between the compression stage and the atmosphere outside the pump system, and further comprising an actuator disposed outside the gas passageway and operatively coupled to the secondary pumping mechanism so as to reciprocate the secondary pumping mechanism within the gas passageway.

* * * * *